US006729872B2

(12) United States Patent
Kobusch

(10) Patent No.: US 6,729,872 B2
(45) Date of Patent: May 4, 2004

(54) METHOD FOR PROTECTING AN $SiO_2$ COATING, AND COMBUSTION DEVICE WITH PROTECTION

(75) Inventor: Manfred Kobusch, München (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/288,211

(22) Filed: Nov. 5, 2002

(65) Prior Publication Data

US 2003/0118959 A1 Jun. 26, 2003

Related U.S. Application Data

(63) Continuation of application No. PCT/EP01/04578, filed on Apr. 23, 2001.

(30) Foreign Application Priority Data

May 5, 2000 (EP) ..... 00109648

(51) Int. Cl.[7] ..... F23J 7/00; F23B 7/00; C10L 1/12

(52) U.S. Cl. ..... 431/4; 431/2; 110/343; 44/320; 427/237; 264/30

(58) Field of Search ..... 431/4, 2, 23; 110/343, 110/342; 44/320; 427/237; 264/30

(56) References Cited

U.S. PATENT DOCUMENTS

| | | | | |
|---|---|---|---|---|
| 2,902,983 A | * | 9/1959 | Patberg | 123/1 R |
| 3,817,722 A | | 6/1974 | Scott | |
| 4,253,408 A | | 3/1981 | Kramer | |
| 4,466,997 A | * | 8/1984 | Prescott | 427/140 |
| 4,473,379 A | | 9/1984 | Liu | |
| 4,567,730 A | | 2/1986 | Scott | |
| 5,353,722 A | | 10/1994 | Vassiliou et al. | |
| 5,851,679 A | | 12/1998 | Stowell et al. | |
| 5,853,435 A | | 12/1998 | Avery et al. | |
| 6,517,341 B1 | * | 2/2003 | Brun et al. | 431/2 |

FOREIGN PATENT DOCUMENTS

| | | |
|---|---|---|
| DE | 195 05 807 A1 | 8/1996 |
| GB | 777518 | 6/1957 |

* cited by examiner

*Primary Examiner*—Alfred Basichas
(74) *Attorney, Agent, or Firm*—Laurence A. Greenberg; Werner H. Stemer; Gregory L. Mayback

(57) ABSTRACT

A method for protecting a $SiO_2$ coating on defining surfaces of a combustion chamber and a combustion device containing the protection. Accordingly, an additive is introduced into the combustion chamber, which increases the SiO content of the exhaust gas, arising from a combustion process. The SiO content helps protect walls of the combustion chamber formed with the $SiO_2$ coating.

15 Claims, 2 Drawing Sheets

METHOD FOR PROTECTING AN $SiO_2$ COATING, AND COMBUSTION DEVICE WITH PROTECTION

CROSS-REFERENCE TO RELATED APPLICATION

This application is a continuation of copending International Application No. PCT/EP01/04578, filed Apr. 23, 2001, which designated the United States and was not published in English.

BACKGROUND OF THE INVENTION

Field of the Invention

The present invention relates to a method for protecting an $SiO_2$ coating on boundary surfaces of a combustion chamber to which a combustion medium is fed, and to a device for combustion of a combustion medium, having a combustion chamber, in which a combustion operation takes place, and a burner for supplying the combustion medium, boundary surfaces of the combustion chamber having an $SiO_2$ coating, in particular for carrying out the method according to the invention. It also relates to a combustion medium for use in a method of this type or a device of this type.

An $SiO_2$ layer is formed on materials which are exposed to high temperatures, in particular on (Si-containing), non-oxidic and Si-containing, oxidic high-temperature materials. The layer protects the materials in operation. In practice, however, corrosion occurs when these materials are used in combustion chambers. The reason for this is that the composition of the flue gases that are formed prevents a protective layer of this type from building up or dissolves a protective layer that is already present. Particularly in the event of interaction with steam, SiO is formed, a compound which is volatile on account of its high vapor pressure, reduces the thickness of the $SiO_2$ layer and therefore leads to a constant attack on the base material. In the case of oxidic materials, the material composite at the surface is broken down by the evaporation of the $SiO_2$ protective layer. Therefore, despite their otherwise highly favorable high-temperature properties, these materials have only a limited service life.

SUMMARY OF THE INVENTION

It is accordingly an object of the invention to provide a method for protecting an $SiO_2$ coating, and a combustion device with the protection that overcome the above-mentioned disadvantages of the prior art methods and devices of this general type.

With the foregoing and other objects in view there is provided, in accordance with the invention, a method for protecting an $SiO_2$ coating on boundary surfaces of a combustion chamber being fed a combustion medium. The method includes adding an additive to the combustion chamber for increasing a SiO content of flue gases formed in a combustion operation.

According to the invention, in the method of the type described in the introduction, the object is achieved through the fact that an additive that increases the SiO content of the flue gases formed in a combustion operation is added to the combustion chamber. The device according to the invention provides an additional device for adding an additive that increases the SiO content of the flue gases formed in the combustion operation.

The SiO content of the flue gases is increased by the addition of the additive. The evaporation from the existing $SiO_2$ coating is significantly reduced or completely prevented as a result of this increase.

The additive that is added is advantageously an organosilicon compound, an ester of silicic acid or a mixture thereof. The additives are inexpensive and are easy to handle.

In an advantageous configuration, the additive is added in an amount that corresponds to 1 ppm to 1% by weight, in particular approximately 10 ppm to 1% by weight, of the combustion medium that is fed to the combustion operation. The quantity that is actually added is dependent on the boundary conditions, such as for example the temperature and the pressure in the combustion chamber and any natural level of SiO, $SiO_2$, an organosilicon compound or an ester of silicic acid that may be present in the combustion medium. Since the quantity of the additive that is added is very low, the combustion operation itself remains virtually unaffected.

In the case of combustion operations that take place under substantially steady-state conditions, the required quantity of the additive can be determined on a one-off basis, and this defined quantity can then always be added. There is no need for complex and detailed measurements or calculations.

On the other hand, according to an advantageous refinement, in the case of fluctuating combustion operations and/or by way of example, quantities of fuel that fluctuate over the course of time, the SiO content of the flue gases is measured, and the amount of additive which is added is regulated as a function of the measured value. This always allows the desired SiO content of the flue gases to be maintained even in the event of fluctuating boundary conditions.

As an alternative or in addition, it is possible to measure a parameter of the flue gases from which the vapor pressure of the $SiO_2$ coating can be calculated. The quantity of additives that is added is once again regulated as a function of the measured value. Measuring the SiO content of the flue gases is relatively complicated. In contrast, the vapor pressure of the $SiO_2$ coating can be calculated on the basis of the temperature and pressure in the combustion chamber. Both temperature and pressure are easy to measure. Furthermore, the temperature of the combustion operation is generally already being measured in order to maintain the predetermined operating state and to minimize the emission of pollutants. The additional outlay is therefore low.

In a first advantageous configuration, the additive is added to the combustion chamber separately from the combustion medium. In this procedure, any desired additive in liquid, gaseous or pulverized form can be used. The properties of the additive do not have to be matched to the combustion medium.

According to a second advantageous configuration, the additive is admixed with the combustion medium and added to the combustion chamber together with the combustion medium. In this case, only a single addition device is required for the combustion medium and the additive.

According to an advantageous refinement, the additive is soluble in the combustion medium. This facilitates the addition of the additive. There is no precipitation of the additive even if the addition of combustion medium stops briefly. The additive can in this case be added to the combustion medium as early as at the refinery, so that there is no need for any changes in the combustion chamber.

It is advantageous for the additive to be combustible. This prevents any deterioration to the efficiency as a result of the introduction of incombustible substances to the combustion chamber.

With the foregoing and other objects in view there is provided, in accordance with the invention, a device for combustion of a combustion medium. The device contains a combustion chamber for carrying out a combustion operation, the combustion chamber having boundary surfaces with an $SiO_2$ coating. A burner is provided for supplying the combustion medium and is disposed in the combustion chamber. An adding device is provided for adding an additive for increasing a SiO content of flue gases formed in the combustion operation.

In an advantageous refinement of the device according to the invention, there is at least one sensor for measuring the SiO content and/or the temperature of the flue gases in the combustion chamber. The sensor can be used to measure the SiO content or to calculate the vapor pressure of the $SiO_2$ coating. The quantity of additive that is added is regulated as a function of the measure value.

The burner of the device has either a nozzle for adding the additive separately from the combustion medium or a nozzle for supplying a mixture of additive and combustion medium. In the first configuration, the additive can be added independently of the combustion medium and therefore does not necessarily have to be matched to the latter. The second configuration advantageously uses an additive that is soluble in the combustion medium. The burner of the device may, for example, be configured as a burner of a gas turbine, and the combustion chamber can accordingly be configured as a gas-turbine combustion chamber.

It is advantageous to provide a pump for metering the quantity of additive that is added. The pump allows a targeted, in particular accurately metered feed of the quantity that is desired in each instance.

An additive that increases the SiO content of the flue gases formed in a combustion operation is admixed with the combustion medium according to the invention. The additive may be admixed as early as in the refinery or if appropriate at a later time. The procedure is recommended if large quantities of the combustion medium are being taken off and the additive can be held in the combustion medium for prolonged periods without suffering any deterioration. In this case, there is no need for any structural changes to the burner itself, which is a particularly cost-effective option.

Other features which are considered as characteristic for the invention are set forth in the appended claims.

Although the invention is illustrated and described herein as embodied in a method for protecting an $SiO_2$ coating, and a combustion device with the protection, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
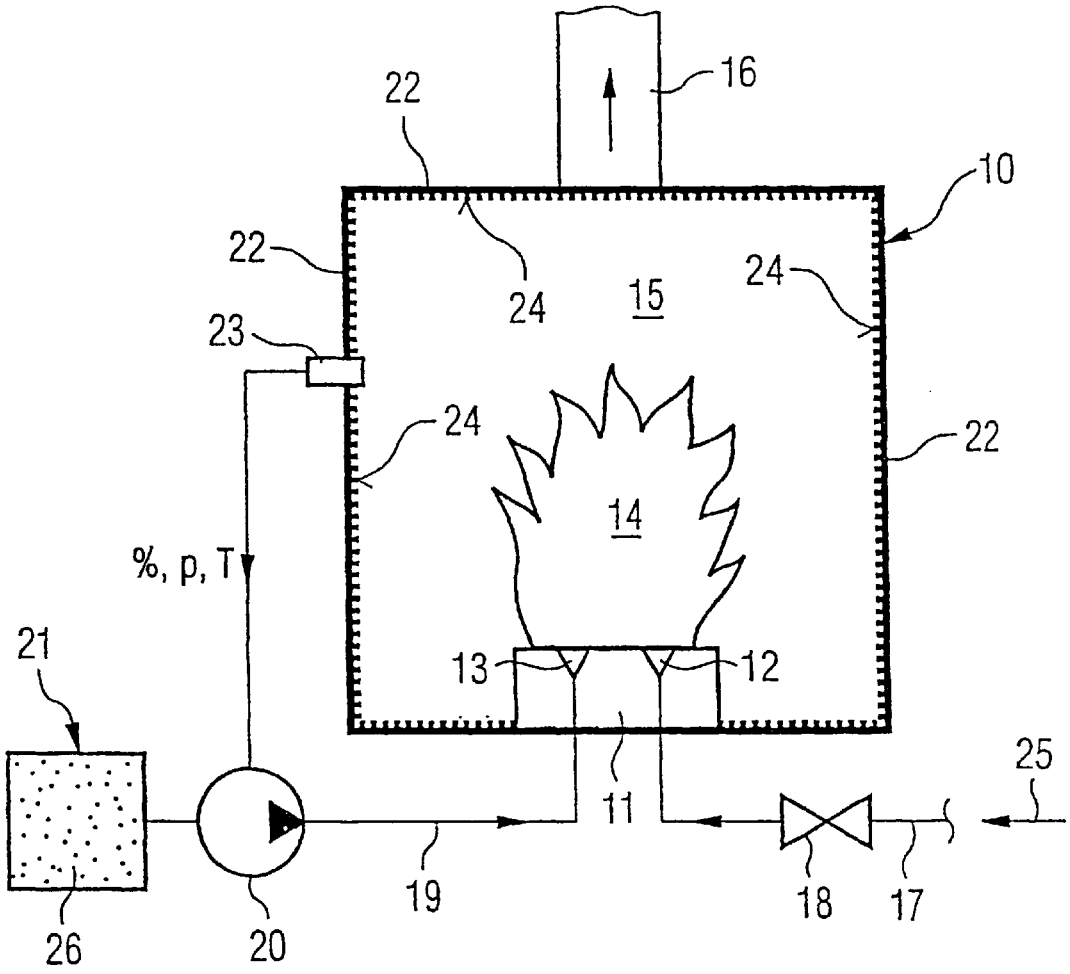
FIG. 1 is a diagrammatic depiction of a combustion chamber in which a process according to the invention and the device according to the invention are used.
Figure 2:
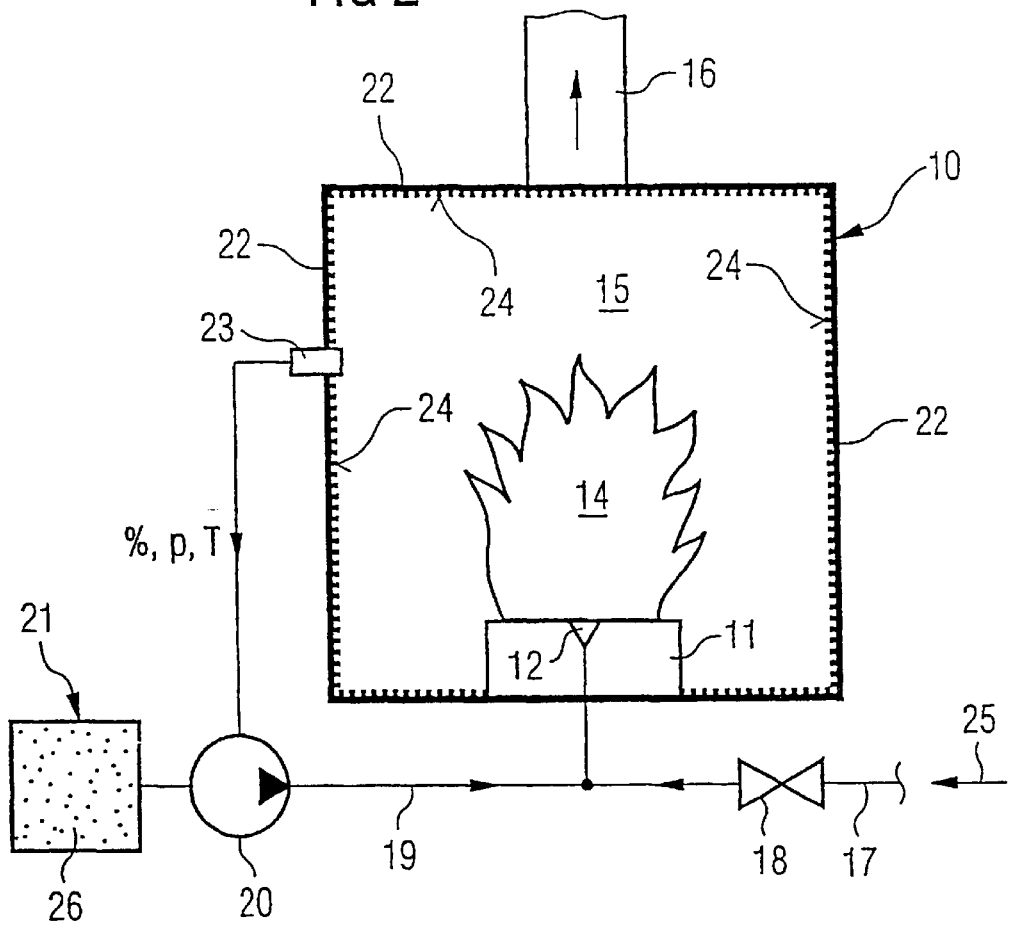
FIG. 2 is a diagrammatic depiction of a second configuration of the invention in a view corresponding to that shown in FIG. 1.

Referring now to the figures of the drawing in detail and first, particularly, to FIGS. 1 and 2 thereof, there is shown, in both configurations, a combustion chamber 10, in which a burner 11 is disposed. The combustion chamber 10 is delimited by boundary surfaces 22 with a $SiO_2$ coating 24. A combustion medium 25 is fed to a nozzle 12 via a line 17 with a shut-off valve 18. It is ignited by a device that is not shown in more detail, so that a combustion operation is formed in the form of a flame 14.

The combustion gives rise to a formation of flue gases 15, which collect in the combustion chamber 10 and are discharged via a discharge 16, for example to a non-illustrated steam generator.

Furthermore, an additive 26 is added in order to protect the $SiO_2$ coating 24 on the boundary surfaces 22. The additive 26 is held in a vessel 21 and is added via a pump 20 and line 19. The pump 20 is used to meter the quantity of additive 26 that is added.

In the configuration shown in FIG. 1, the additive 26 is added separately from the combustion medium 25, via a dedicated nozzle 13. It is therefore possible to select an additive 26 that is incompatible with the combustion medium 25. In contrast, in the configuration shown in FIG. 2, the additive 26 is admixed with the combustion medium 25 and added to the combustion chamber 10 together with the combustion medium 25 via the common nozzle 12. This procedure is recommended in particular if the additive 26 is soluble in the combustion medium 25, for example if the additive is present in the form of an organosilicon compound. In both cases, it is advantageous to use a combustible additive 26. The quantity that is added approximately corresponds to 1 ppm to 1% by weight, in particular approximately 10 ppm to 1% by weight, of the combustion medium.

In the case of combustion with a steady-state flame 14, the desired quantity of the additive 26 is determined and is then retained unchanged in steady-state operation. Alternatively, or in the case of a varying flame 14 there is a sensor 23 for monitoring the combustion chamber 10. The SiO content of the flue gases 15 can be noted using the sensor 23, and the amount of the additive 26 that is added can be regulated as a function of the measured value. This is diagrammatically illustrated by the arrow running from the sensor 23 to the pump and the percent symbol next to it.

Alternatively or in addition, the pressure and/or the temperature of the flue gases 15 can be recorded. The vapor pressure of the $SiO_2$ coating 24 is a function of pressure and temperature of the flue gases 15. The prevailing vapor pressure can therefore in each case be calculated from a recording of the temperature and pressure. To simplify the method, the pressure can be assumed to be ambient pressure. Working on the basis of the calculated vapor pressure of the $SiO_2$ coating 24, the pump 20 is actuated in order to add the required quantity of the additive 26. This results in saturation of the flue gases 15, so that evaporation of SiO from the $SiO_2$ coating 24 is prevented or at least substantially suppressed.

After the flue gases 15 have escaped via the discharge 16, the SiO that is present in the flue gases 15 is converted into $SiO_2$ and thus made environmentally tolerable.

Figure 3:
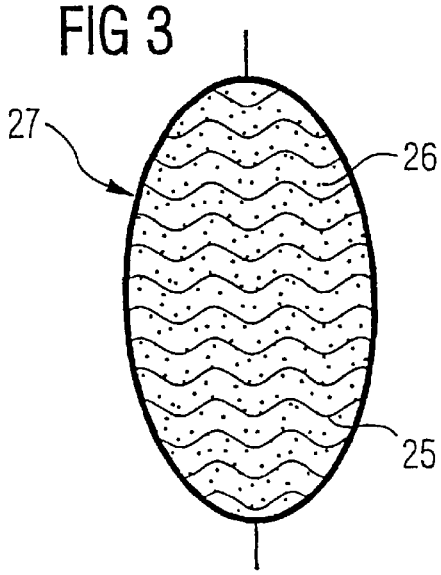
FIG. 3 is a diagrammatic depiction of a combustion medium.

FIG. 3 diagrammatically depicts an illustration of a vessel 27 in which the combustion medium 25 with levels of the additive 26 is held. The additive 26, which is diagrammatically indicated by dots, is soluble for prolonged periods in the combustion medium 25, which is symbolically illustrated by wavy lines. If the combustion medium 26 of this type is used, there is no need for any configuration changes to the burner 11.

However, it is also possible for only a defined basic quantity of additive 26, which is required for all combustion conditions, to be added. The amount that is additionally required in individual cases is then added as illustrated in FIG. 1 or 2 in order to obtain the desired quantity of additive 26 in the combustion chamber 10.

Overall the addition of the additive increases the SiO content of the flue gases 15 and in this way protects the $SiO_2$ coating 24 in the combustion chamber 10.

I claim:

1. A method for protecting an $SiO_2$ coating on boundary surfaces of a combustion chamber being fed a combustion medium, which comprises the steps of:

adding an additive to the combustion chamber for increasing a SiO content of flue gases formed in a combustion operation;

measuring the SiO content of the flue gases; and regulating a quantity of the additive added in dependence on the SiO content measured.

2. The method according to claim 1, wherein the adding step comprises selecting the additive from the group consisting of an organosilicon compound, an ester of silicic acid and a mixture thereof.

3. The method according to claim 1, wherein the adding step comprises adding the additive in an amount corresponding to 1 ppm to 1% by weight of the combustion medium fed to the combustion operation.

4. The method according to claim 1, which comprises adding the additive to the combustion chamber separately from the combustion medium.

5. The method according to claim 1, which comprises admixing the additive with the combustion medium resulting in the additive being added to the combustion chamber together with the combustion medium.

6. The method according to claim 1, which comprises selecting the additive to be soluble in the combustion medium.

7. The method according to claim 1, which comprises selecting the additive to be a combustible additive.

8. The method according to claim 1, wherein the adding step comprises adding the additive in an amount corresponding to 10 ppm to 1% by weight of the combustion medium fed to the combustion operation.

9. A method for protecting an $SiO_2$ coating on boundary surfaces of a combustion chamber being fed a combustion medium, which comprises the steps of:

adding an additive to the combustion chamber for increasing a SiO content of flue gases formed in a combustion operation;

measuring a parameter of the flue gases and using the parameter measured to calculate a vapor pressure of the $SiO_2$ coating; and regulating an amount of the additive added in dependence on the parameter measured.

10. The method according to claim 9, wherein the adding step comprises selecting the additive from the group consisting of an organosilicon compound, an ester of silicic acid and a mixture thereof.

11. A device for combustion of a combustion medium, comprising:

a combustion chamber for carrying out a combustion operation, said combustion chamber having boundary surfaces with an $SiO_2$ coating;

a burner for supplying the combustion medium and disposed in said combustion chamber;

an adding device for adding an additive for increasing an SiO content of flue gases formed in the combustion operation; and at least one sensor for measuring at least one of the SiO content and a temperature of the flue gases in said combustion chamber.

12. A device for combustion of a combustion medium, comprising:

a combustion chamber for carrying out a combustion operation, said combustion chamber having boundary surfaces with an $SiO_2$ coating;

a burner for supplying the combustion medium and disposed in said combustion chamber;

an adding device for adding an additive for increasing an SiO content of flue gases formed in the combustion operation; and said burner having a nozzle for adding the additive separately from the combustion medium, said nozzle one of connected to said adding device and forming part of said adding device.

13. A device for combustion of combustion medium, comprising:

a combustion chamber for carrying out a combustion operation, said combustion chamber having boundary surfaces with an $SiO_2$ coating;

a burner for supplying the combustion medium and disposed in said combustion chamber;

an adding device for adding an additive for increasing an SiO content of flue gases formed in the combustion operation; and said burner having a nozzle for supplying a mixture of the additive and the combustion medium, said nozzle one of connected to said adding device and forming part of said adding device.

14. A device for combustion of a combustion medium, comprising:

a combustion chamber for carrying out a combustion operation, said combustion chamber having boundary surfaces with an $SiO_2$ coating;

a burner for supplying the combustion medium and disposed in said combustion chamber;

an adding device for adding an additive for increasing an SiO content of flue gases formed in the combustion operation; and a pump for metering a quantity of the additive that is added, said pump fluidically communicating with said adding device.

15. The device according to claim 14, further comprising at least one sensor for measuring at least one of an SiO content and a temperature of the flue gases in said combustion chamber.

* * * * *